US007461891B1

(12) United States Patent
Andersen

(10) Patent No.: US 7,461,891 B1
(45) Date of Patent: Dec. 9, 2008

(54) COLLAPSIBLE FRAME FOR HOLDING A BABY CARRIER AND ASSOCIATED METHOD

(76) Inventor: Eileen Andersen, 9341 Fairmount Dr., Tobyhanna, PA (US) 19466

( * ) Notice: Subject to any disclaimer, the term of this patent is extended or adjusted under 35 U.S.C. 154(b) by 0 days.

(21) Appl. No.: 11/977,771

(22) Filed: Oct. 26, 2007

Related U.S. Application Data

(60) Provisional application No. 60/854,152, filed on Oct. 26, 2006.

(51) Int. Cl.
*A47D 1/02* (2006.01)

(52) U.S. Cl. ..... 297/44; 297/16.1

(58) Field of Classification Search ..... 297/5, 297/6, 16.1, 16.2, 42, 44, 130; 135/65–67, 135/74

See application file for complete search history.

(56) References Cited

U.S. PATENT DOCUMENTS 2,433,090 A * 12/1947 Cass ..... 297/44
4,643,211 A * 2/1987 Morris et al. ..... 135/67
4,826,240 A * 5/1989 Karpiuk ..... 297/6
5,332,241 A 7/1994 Rho
5,353,824 A * 10/1994 Woods et al. ..... 135/66
5,380,262 A * 1/1995 Austin ..... 297/5
5,904,168 A * 5/1999 Alulyan ..... 297/6
6,062,648 A * 5/2000 Adler ..... 297/440.24
6,290,290 B1 9/2001 Kokuzian
6,619,734 B2 9/2003 Helmsderfer
7,108,004 B2 * 9/2006 Cowie et al. ..... 135/74

* cited by examiner

*Primary Examiner*—Peter R. Brown

(57) ABSTRACT

A collapsible support frame includes a collapsible frame that extends upwardly from a ground surface and has a fixed vertical height. Such a frame includes a plurality of rectilinear rails equidistantly spaced apart and disposed at opposed corners of the frame. The frame further includes a seat support section, a plurality of rods, and a seat belt directly connected to the seat support section and projecting forwardly towards an anterior side of the frame. A mechanism for maintaining the selected rods is evenly registered along a horizontal plane when the frame is erected such that the selected rods become downwardly displaced from the horizontal plane when the maintaining mechanism is repositioned along a longitudinal length of the selected rods as the frame is collapsed.

12 Claims, 4 Drawing Sheets

COLLAPSIBLE FRAME FOR HOLDING A BABY CARRIER AND ASSOCIATED METHOD

CROSS REFERENCE TO RELATED APPLICATIONS

This application claims the benefit of U.S. Provisional Application No. 60/854,152, filed Oct. 26, 2006, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to collapsible frames and, more particularly, to a collapsible frame for holding a baby carrier.

2. Prior Art

One of the most important criteria in the busy lives of today's parents and caregivers is convenience and comfort in all aspects whether at home or visiting family, friends, events or dining out at restaurants. Parents appreciate concepts that facilitate efficiency, safety and mobility to accommodate the needs of their infants and toddlers, thereby, making their life easier.

A baby accessory that is commonly used for transporting babies is called, quite appropriately, a baby carrier. Parents use baby carriers to transport their infants and take toddlers to various places including restaurants when they elect to have dinner or some other meal away from home. Restaurants are primarily designed to cater to adults but many do carry a few high chairs to accommodate customers with infants and toddlers. The high chairs used by restaurants are usually wooden high chairs with a seat and/or a movable tray which can be lifted up to fit a baby in the chair and pulled downward after the baby is properly positioned.

These chairs, with the exception of the one with the movable tray, are rigidly constructed and take up an inordinate amount of space in a restaurant when they are not being used. Additionally, as noted earlier, many parents carry their infant to a restaurant in a baby carrier. The wooden restaurant chair to hold the baby carrier must be reversed to accommodate the baby carrier after that end of the chair has been on the floor. Then the chair is reversed again to accommodate a toddler. Most times the wooden chair provided for this type of usage must be carried overhead by the server across the restaurant. Obviously, it would be advantageous to provide a means for resolving these types of problems.

U.S. Pat. No. 5,332,241 in the name of Rho discloses a high-chair with a base stand constituted by two mutually foldable arms. A chair-like body is slidably supported on one of the arms and has a back which is rigidly associated with guiding elements for sliding on the related arm. A seat is hinged to the back and is in turn hinged to a foot-rest which can be folded, together with the seat, toward the back. Elements are provided for releasably locking the chair body onto the related arm and allow a continuous sliding of the chair body on the arm for movement in the direction of lifting the chair body and, in discrete and successive portions, for movement in the direction of lowering the chair body. Unfortunately, this prior art example does not provide a method for supporting a baby carrier.

U.S. Pat. No. 6,290,290 to Kokuzian discloses an infant car seat support assembly for securing an infant car seat to a portable support assembly. The infant car seat support assembly includes a pair of support members. Each support member has a pair of legs and a cross member extending between upper ends of the pair of legs. The support members are pivotally coupled to each other in a manner such that the cross members are positioned in a substantially parallel spaced relationship to each other to define an open position. The infant car seat support assembly also has at least one brace member that has opposite ends. Each end of the brace member is couplable to a respective one of the cross members for holding the support members in the open position. One of the cross members is designed to securely engage an infant car seat clip, whereby the infant car seat support assembly can be securely engaged to the infant car seat. Unfortunately, this prior art example is not designed for also functioning as a standard high chair.

U.S. Pat. No. 6,619,734 to Helmsderfer discloses a multipurpose child support device comprised of a frame having a base for placement on a floor surface and a support section positioned above said base. A seat element is configured for receiving a toddler child in a sitting position and is coupled with the support section above the floor surface for forming a high chair. The seat element is displaceably mounted to the frame and is operable for being selectively removed from the support section such that the support section receives an infant child carrier for supporting an infant child carrier above a floor surface. Unfortunately, this prior art example is not collapsible and thereby easily stored.

Accordingly, the present invention is disclosed in order to overcome the above noted shortcomings. The present invention is convenient and easy to use, lightweight yet durable in design, and designed for holding a baby carrier. The collapsible support frame is simple to use, inexpensive, and designed for many years of repeated use.

BRIEF SUMMARY OF THE INVENTION

In view of the foregoing background, it is therefore an object of the present invention to provide an apparatus for supporting a baby carrier. These and other objects, features, and advantages of the invention are provided by a collapsible support frame.

A collapsible support frame includes a collapsible frame that effectively extends upwardly from a ground surface and has a fixed vertical height. Such a frame includes a plurality of rectilinear rails equidistantly spaced apart and disposed at opposed corners of the frame. Such rails maintain a static longitudinal length while the frame is adapted between collapsed and erected positions. Selected ones of the rails include brackets extending medially and inwardly therefrom.

The frame further includes a seat support section with opposed corners connected to the brackets and other ones of the rails respectively. Such a seat support section is conveniently folded and unfolded when the frame is collapsed and erected respectively, and is bifurcated into pivotally coupled anterior and posterior segments. Such anterior and posterior segments is pivotal about a fulcrum axis spanning along an entire width of the frame in such a manner that medial edges of the anterior and posterior segments bend downwardly and away from the selected rods when the frame is collapsed. Lateral edges of the anterior and posterior segments are articulated adjacent to the rails and maintained at an equidistant height from the top ends of the rails during collapsing operations.

The frame further includes a plurality of rods with opposed ends directly connected to top ends of the rails respectively. Selected ones of such rods is downwardly biased when the frame is articulated to the collapsed position, and the selected rods are advantageously bifurcated into anterior and posterior sections vertically aligned above the anterior and posterior segments of the seat support section respectively. Each of such anterior and posterior sections has detachable medial ends abutted against each other during the erected position and thereby axially aligned along the horizontal plane defined orthogonal to the rails. Such medial ends are downwardly adapted when the frame is collapsed such that a spatial relationship between the other rods is reduced.

The frame further includes a seat belt directly connected to the seat support section and projecting forwardly towards an anterior side of the frame, and a seat with monolithically formed back and bottom regions pivotally attached to each other. Such a back region effectively lies parallel to the rails and orthogonal to the anterior and posterior sections when the frame is erected. The bottom region lies parallel to the rods as well as the anterior and posterior sections when the frame is erected. In addition, the seat is removable from the seat support section.

The support frame further includes a tray removably attached directly to the selected rods and situated at an anterior side of the frame. The frame conveniently includes a plurality of brackets intercalated between the selected rods and the tray in such a manner that the tray is slidably adaptable along a longitudinal length of the selected rods and positioned away from the anterior side of the frame as desired by the caregiver.

The apparatus further includes a mechanism for maintaining the selected rods evenly registered along a horizontal plane when the frame is erected such that the selected rods become downwardly displaced from the horizontal plane when the maintaining mechanism is repositioned along a longitudinal length of the selected rods as the frame is collapsed. Such a maintaining mechanism includes a plurality of tubular sleeves telescopically positioned about an outer surface of the selected rods such that the medial ends of the anterior and posterior segments are covered and statically engaged when the frame is erected. Other ones of the rods advantageously travel towards a center of the frame and become adjoined proximate to the center of the frame when the frame is articulated to the collapsed position.

A method for supporting a baby carrier on a collapsible frame includes the steps of: equidistantly spacing apart a plurality of rectilinear rails by disposing the rails at opposed corners of the frame; medially and inwardly extending brackets from selected ones of the rails; directly connecting opposed ends of a plurality of rods to top ends of the rails respectively; directly connecting a seat belt to the seat support section by projecting the seat belt forwardly towards an anterior side of the frame; maintaining selected ones of the rods evenly registered along a horizontal plane when the frame is erected; connecting opposed corners of a seat support section to the brackets and other ones of the rails respectively; downwardly displacing the selected rods from the horizontal plane; proximately adjoining other ones of the rods by displacing the other rods towards a center of the frame; downwardly biasing selected ones of the rods; folding the seat support section; and maintaining the rails at a static longitudinal length.

The method further includes the steps of: pivoting anterior and posterior segments of the seat support section about a fulcrum axis spanning along an entire width of the frame; downwardly biasing medial edges of the anterior and posterior segments away from the selected rods; articulating lateral edges of the anterior and posterior segments adjacent to the rails; and maintaining the lateral edges at an equidistant height from the top ends of the rails.

The method further includes the steps of: detaching medial ends of anterior and posterior sections of the selected rods; downwardly adapting the medial ends when the frame is collapsed such that a spatial relationship between the other rods is reduced; providing a seat with monolithically formed back and bottom regions pivotally attached to each other; laying the back region parallel to the rails and orthogonal to the anterior and posterior sections when the frame is erected respectively; laying the bottom region parallel to the rods as well as the anterior and posterior sections when the frame is erected; and removing the seat from the seat support section during collapsing procedures.

The method further includes the steps of: telescopically positioning a plurality of tubular sleeves about an outer surface of the selected rods; statically engaging medial ends of the anterior and posterior segments by covering the medial ends with the sleeves when the frame is erected; removably attaching a tray directly to the selected rods by situating the tray at an anterior side of the frame; intercalating a plurality of brackets between the selected rods and the tray; and slidably adapting the tray along a longitudinal length of the selected rods by positioning the tray away from the anterior side of the frame as desired by the caregiver.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
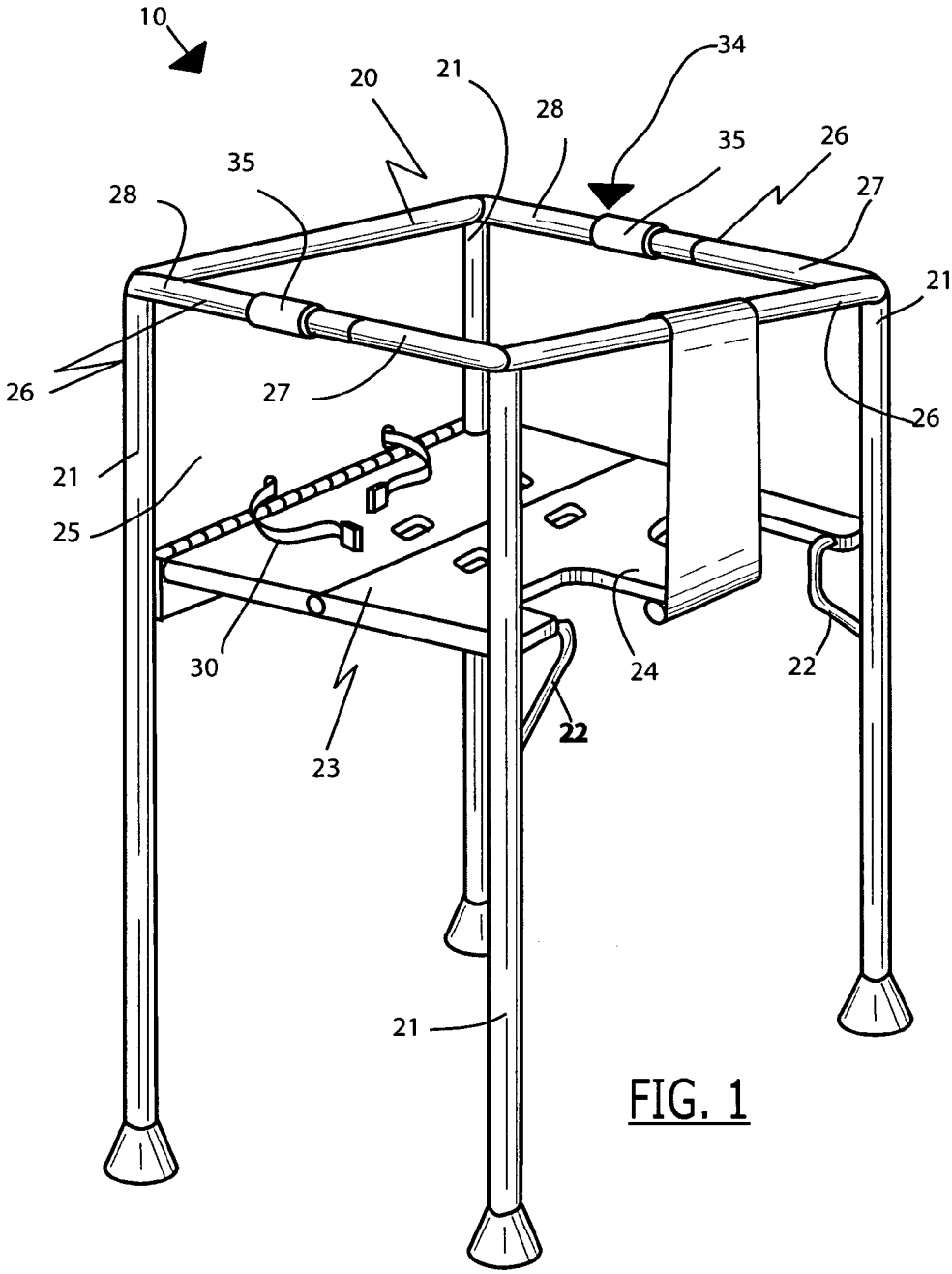
FIG. 1 is a perspective view showing a collapsible support frame, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1-5 by the reference numeral 10 and is intended to protect a collapsible support frame. It should be understood that the apparatus 10 may be used to support many different types of carriers, and should not be limited in use with only those types of carriers mentioned herein.

Referring initially to FIGS. 1, 2, 3 and 4, a collapsible support frame 10 includes a collapsible frame 20 that extends upwardly from a ground surface and has a fixed vertical height. Such a frame 20 includes a plurality of rectilinear rails 21 equidistantly spaced apart and disposed at opposed corners of the frame 20. Such rails 21 maintain a static longitudinal length while the frame 20 is adapted between collapsed and erected positions. Selected ones of the rails 21 include brackets 22 extending medially and inwardly therefrom. The frame can be used to support a baby carrier or, alternately, can be used as a high chair for a child.

Referring again to FIGS. 1, 2, 3 and 4, the frame 20 further includes a seat support section 23 with opposed corners connected to the brackets 22 and other ones of the rails 21 respectively. Such a seat support section 23 is folded and unfolded when the frame 20 is collapsed and erected respectively, and is bifurcated into pivotally coupled anterior and posterior segments 24, 25. Such anterior and posterior segments 24, 25 is pivotal about a fulcrum axis spanning along an entire width of the frame 20 in such a manner that medial edges of the anterior and posterior segments 24, 25 bend downwardly and away from the selected rods when the frame 20 is collapsed. Lateral edges of the anterior and posterior segments 24, 25 are articulated adjacent to the rails 21 and maintained at an equidistant height from the top ends of the rails 21 during collapsing operations. The seat support section 23 is used for supporting a child as opposed to a baby carrier.

Referring to FIGS. 1, 2, 3, 4 and 5, the frame 20 further includes a plurality of rods 26 with opposed ends directly connected, without the use of intervening elements, to top ends of the rails 21 respectively. Selected ones of such rods 26 is downwardly biased when the frame 20 is articulated to the collapsed position, and the selected rods 26 are bifurcated into anterior and posterior sections 27, 28 vertically aligned above the anterior and posterior segments 24, 25 of the seat support section 23 respectively. Each of such anterior and posterior sections 27, 28 has detachable medial ends 29 abutted against each other during the erected position and thereby axially aligned along the horizontal plane defined orthogonal to the rails 21. Such medial ends 29 are downwardly adapted when the frame 20 is collapsed which is essential such that a spatial relationship between the other rods 26 is reduced. The rods 26 are provided for supporting a baby carrier or, alternately, for supporting a tray.

Figure 2:
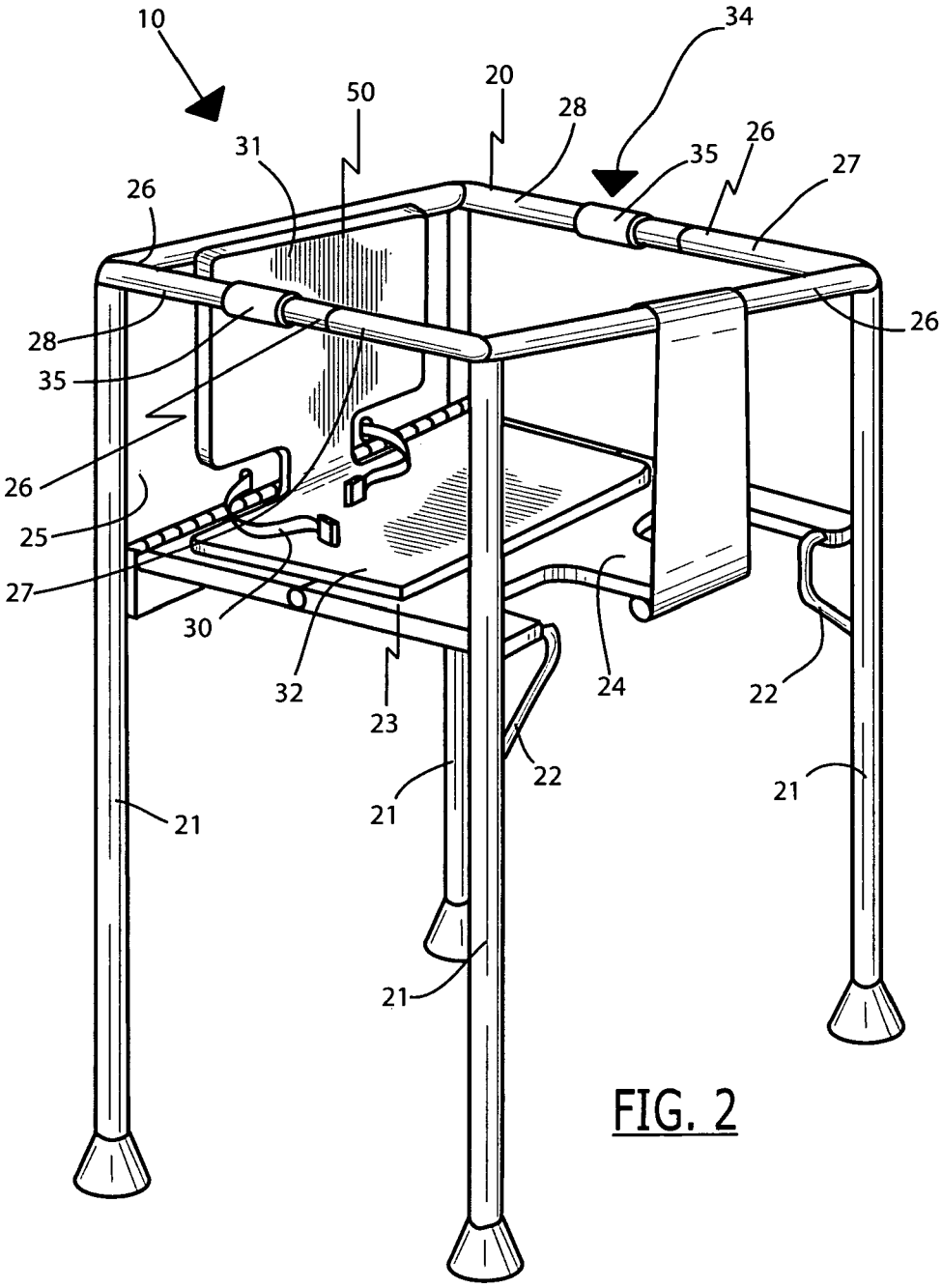
FIG. 2 is a perspective view showing a collapsible support frame, with a removable seat, in accordance with the present invention.
Figure 3:
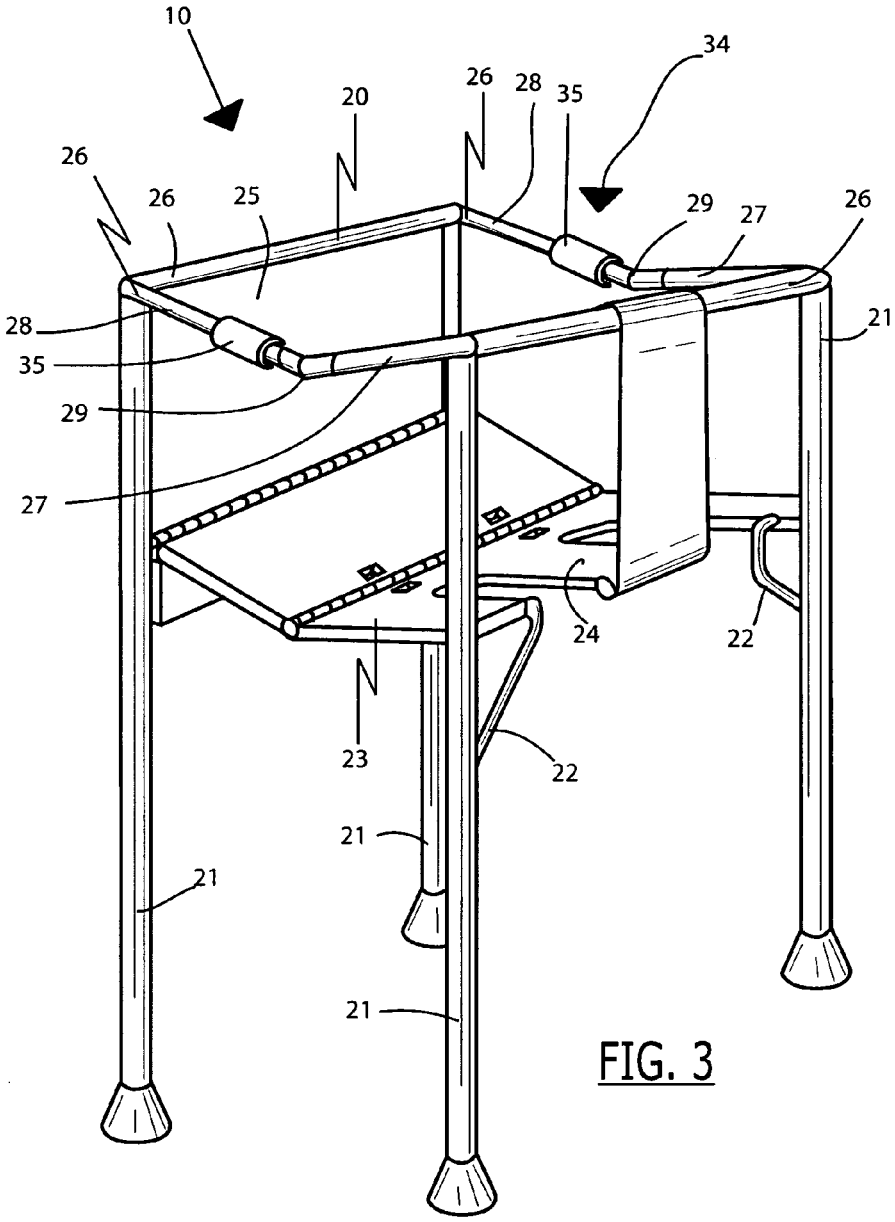
FIG. 3 is a perspective view of a collapsible support frame in a semi-folded position, in accordance with the present invention.
Figure 4:
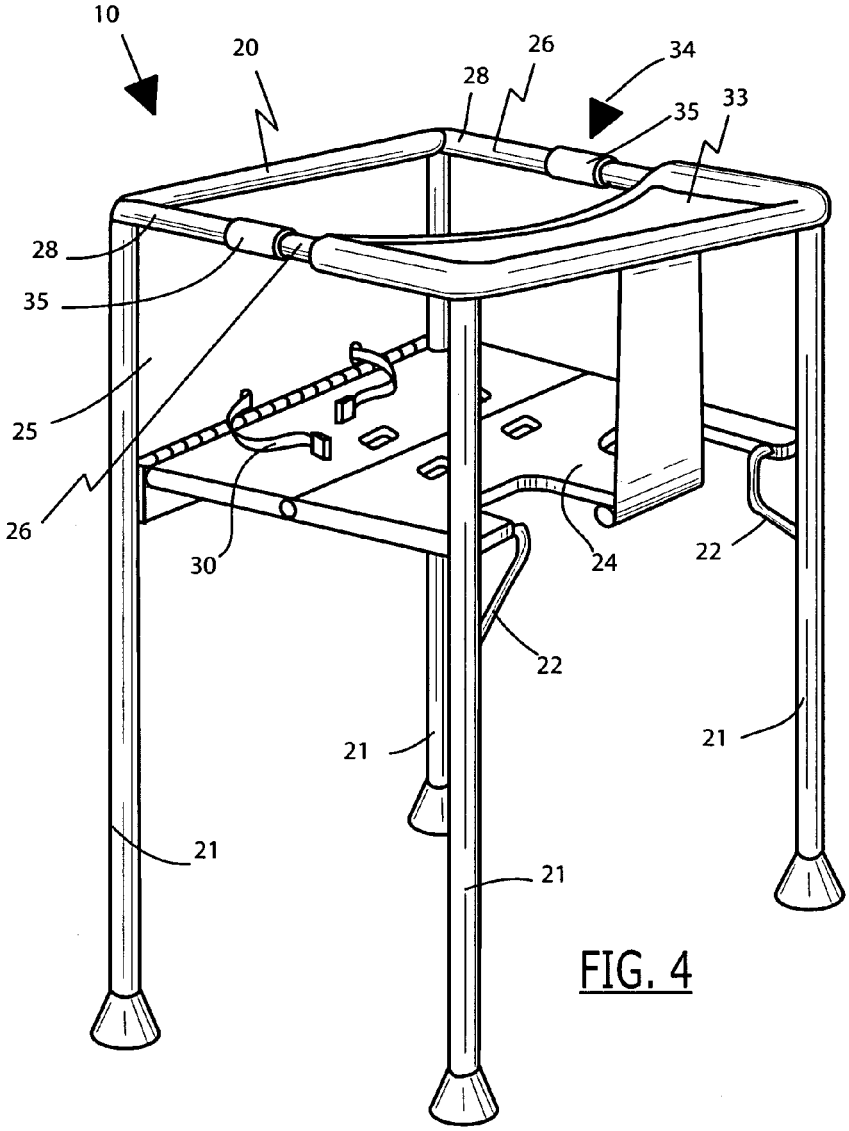
FIG. 4 is a perspective view of a collapsible support frame, with a removable tray, in accordance with the present invention.
Figure 5:
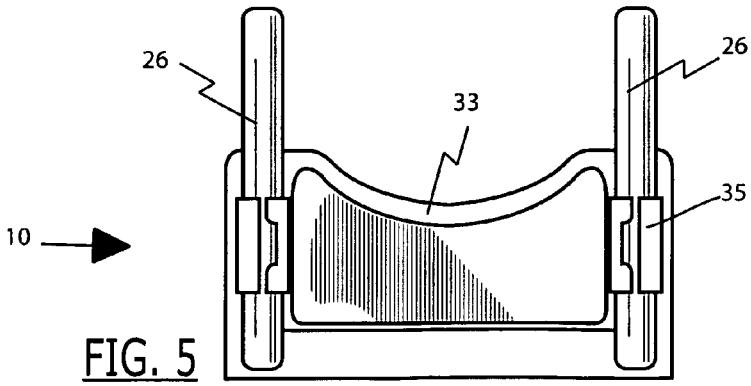
FIG. 5 is a bottom planar view of the removable tray, in accordance with the present invention.

Referring to FIGS. 1, 2 and 3, the frame 20 further includes a seat belt 30 directly connected, without the use of intervening elements, to the seat support section 23 and projecting forwardly towards an anterior side of the frame, and a seat 50 with monolithically formed back and bottom regions 31, 32 pivotally attached to each other. Such a back region 31 lies parallel to the rails 21 and orthogonal to the anterior and posterior sections 27, 28 when the frame 20 is erected. The bottom region 32 lies parallel to the rods 26 as well as the anterior and posterior sections 27, 28 when the frame 20 is erected. In addition, the seat 50 is removable from the seat support section 23. The seat belt 30 is provided for securing a child within the seat portion.

The support frame 20 further includes a tray 33 removably attached directly, without the use of intervening elements, to the selected rods 26 and situated at an anterior side 27 of the frame 20. The frame 20 includes a plurality of brackets 34 intercalated between the selected rods 26 and the tray 33 in such a manner that the tray 33 is slidably adaptable along a longitudinal length of the selected rods 26 and positioned away from the anterior side 27 of the frame 20 as desired by the caregiver.

Referring to FIGS. 1, 2, 3 and 4, the apparatus 10 further includes a mechanism 34 for maintaining the selected rods 26 evenly registered along a horizontal plane when the frame 20 is erected which is important such that the selected rods 26 become downwardly displaced from the horizontal plane when the maintaining mechanism 34 is repositioned along a longitudinal length of the selected rods 26 as the frame 20 is collapsed. Such a maintaining mechanism 34 includes a plurality of tubular sleeves 35 telescopically positioned about an outer surface of the selected rods 26 which is vital such that the medial ends of the anterior and posterior segments 27, 28 are covered and statically engaged when the frame 20 is erected. Other ones of the rods 26 travel towards a center of the frame 20 and become adjoined proximate to the center of the frame 20 when the frame 20 is articulated to the collapsed position. The maintaining mechanism 34 ensures that the support frame remains in the unfolded position during use.

The apparatus features a collapsible frame that accommodates a baby carrier in the upper part of the frame or seats a toddler in the comfortable and securely crafted seat recessed within the frame. The bottoms of the legs of the frame have a slip-proof material, such as rubber for safety. Also, the apparatus includes a collapsible aluminum frame that accommodates a baby carrier that is suitably sized and shaped to be positioned in the upper part of the frame. Such a frame is made from lightweight, sturdy aluminum metal and the toddler seat is produced from plastic materials. Of course, the frame and the toddler seat could be produced from a variety of suitable materials, as is obvious to a person of ordinary skill in the art. The aluminum frame is square-shaped and has a depth of 10" inches. The upper part of the frame affords an open area in the center in which the baby carrier can effectively be securely positioned.

When the apparatus is not being used, the aluminum frame collapses, which is vital and advantageous for greatly reducing the amount of space the frame occupies when it is not being used. The convenience and space saving advantages afforded by the apparatus can beneficially be used by the parents of infants and toddlers and by restaurants for storing other necessities.

The present invention, as claimed, provides the unexpected and unpredictable benefit of an apparatus that is convenient and easy to use, is durable yet lightweight in design, is portable in nature, and provides parents and caregivers with a convenient means for supporting an infant in a carrier and a toddler when placed in seat within the frame while dining out. Such a support stand conveniently folds to a compact shape when not in use, thus allowing for easy storage and transport thereof. The design of the apparatus also ensures that it does not topple over, thus giving parents peace of mind that their infant or toddler is safe when placed within the stand.

In use, a method for supporting a baby carrier on a collapsible frame includes the steps of: equidistantly spacing apart a plurality of rectilinear rails 21 by disposing the rails 21 at opposed corners of the frame 20; medially and inwardly extending brackets 22 from selected ones of the rails; directly connecting, without the use of intervening elements, opposed ends of a plurality of rods 26 to top ends of the rails 21 respectively; directly connecting, without the use of intervening elements, a seat belt 30 to the seat support section 23 by projecting the seat belt 30 forwardly towards an anterior side 27 of the frame 20; maintaining selected ones of the rods 26 evenly registered along a horizontal plane when the frame 20 is erected; connecting opposed corners of a seat support section 23 to the brackets 22 and other ones of the rails 21 respectively; downwardly displacing the selected rods 26 from the horizontal plane; proximately adjoining other ones of the rods 26 by displacing the other rods 26 towards a center of the frame 20; downwardly biasing selected ones of the rods 26; folding the seat support section 23; and maintaining the rails 21 at a static longitudinal length.

In use, the method further includes the steps of: pivoting anterior and posterior segments 24, 25 of the seat support section 23 about a fulcrum axis spanning along an entire width of the frame 20; downwardly biasing medial edges of the anterior and posterior segments 24, 25 away from the selected rods 26; articulating lateral edges of the anterior and posterior segments 24, 25 adjacent to the rails 21; and maintaining the lateral edges at an equidistant height from the top ends of the rails 21.

In use, the method further includes the steps of: detaching medial ends of anterior and posterior sections 24, 25 of the selected rods 26; downwardly adapting the medial ends when the frame 20 is collapsed such that a spatial relationship between the other rods 26 is reduced; providing a seat 50 with monolithically formed back and bottom regions 31, 32 pivotally attached to each other; laying the back region parallel to the rails 21 and orthogonal to the anterior and posterior sections 24, 25 when the frame 20 is erected respectively; laying the bottom region parallel to the rods 26 as well as the anterior and posterior sections 24, 25 when the frame 20 is erected; and removing the seat 50 from the seat support section 23 during collapsing procedures.

In use, the method further includes the steps of: telescopically positioning a plurality of tubular sleeves 35 about an outer surface of the selected rods 26; statically engaging medial ends of the anterior and posterior segments 24, 25 by covering the medial ends with the sleeves 35 when the frame 20 is erected; removably attaching a tray 33 directly, without the use of intervening elements, to the selected rods 26 by situating the tray 33 at an anterior side 27 of the frame 20; intercalating a plurality of brackets between the selected rods 26 and the tray 33; and slidably adapting the tray 33 along a longitudinal length of the selected rods 26 by positioning the tray 33 away from the anterior side of the frame 20 as desired by the caregiver.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A collapsible support frame for supporting a baby carrier, said support frame comprising:

a collapsible frame extending upwardly from a ground surface and having a fixed vertical height, said frame including a plurality of rectilinear rails equidistantly spaced apart and disposed at opposed corners of said frame, said rails maintaining a static longitudinal length while said frame is adapted between collapsed and erected positions, selected ones of said rails including brackets extending medially and inwardly therefrom, a seat support section having opposed corners connected to said brackets and other ones of said rails respectively, said seat support section being folded and unfolded when said frame is collapsed and erected respectively, a plurality of rods having opposed ends directly connected to top ends of said rails respectively, selected ones of said rods being downwardly displaced from the erected position, and means for maintaining said selected rods evenly registered along a horizontal plane when said frame is erected such that said selected rods become downwardly displaced from said horizontal plane when said maintaining means is repositioned along a longitudinal length of said selected rods as said frame is collapsed;

wherein other ones of said rods travel towards a center of said frame and become adjoined proximate to the center of said frame when said frame is articulated to the collapsed position.

2. The support frame of claim 1, wherein said seat support section is bifurcated into pivotally coupled anterior and posterior segments, said anterior and posterior segments being pivotal about a fulcrum axis spanning along an entire width of said frame in such a manner that medial edges of said of said anterior and posterior segments bend downwardly and away from said selected rods when said frame is collapsed, lateral edges of said anterior and posterior segments being articulated adjacent to said rails and maintained at an equidistant height from said top ends of said rails during collapsing operations.

3. The support frame of claim 2, wherein said selected rods are bifurcated into anterior and posterior sections vertically aligned above said anterior and posterior segments of said seat support section respectively, each of said anterior and posterior sections having detachable medial ends abutted against each other during the erected position and thereby axially aligned along the horizontal plane defined orthogonal to said rails, said medial ends being downwardly adapted when said frame is collapsed such that a spatial relationship between said other rods is reduced.

4. The support frame of claim 3, further comprising: a seat having monolithically formed back and bottom regions pivotally attached to each other, said back region laying parallel to said rails and orthogonal to said anterior and posterior sections when said frame is erected, said bottom region laying parallel to said rods as well as said anterior and posterior sections when said frame is erected, said seat being removable from said seat support section.

5. The support frame of claim 3, wherein said maintaining means comprises: a plurality of tubular sleeves telescopically positioned about an outer surface of said selected rods such that said medial ends of said anterior and posterior segments are covered and statically engaged when said frame is erected.

6. The support frame of claim 1, further comprising: a tray removably attached directly to said selected rods and situated at an anterior side of said frame, said frame including a plurality of brackets intercalated between said selected rods and said tray in such a manner that said tray is slidably adaptable along a longitudinal length of said selected rods and positioned away from said anterior side of said frame as desired by the caregiver.

7. A collapsible support frame for supporting a baby carrier, said support frame comprising:

a collapsible frame extending upwardly from a ground surface and having a fixed vertical height, said frame including a plurality of rectilinear rails equidistantly spaced apart and disposed at opposed corners of said frame, said rails maintaining a static longitudinal length while said frame is adapted between collapsed and erected positions, selected ones of said rails including brackets extending medially and inwardly therefrom, a seat support section having opposed corners connected to said brackets and other ones of said rails respectively, said seat support section being folded and Unfolded when said frame is collapsed and erected respectively, a plurality of rods having opposed ends directly connected to top ends of said rails respectively, selected ones of said rods being downwardly displaced from the erected position, and a seat belt directly connected to said seat support section and projecting forwardly towards an anterior side of said frame;

means for maintaining said selected rods evenly registered along a horizontal plane when said frame is erected such that said selected rods become downwardly displaced from said horizontal plane when said maintaining means is repositioned along a longitudinal length of said selected rods as said frame is collapsed;

wherein other ones of said rods travel towards a center of said frame and become adjoined proximate to the center of said frame when said frame is articulated to the collapsed position.

8. The support frame of claim 7, wherein said seat support section is bifurcated into pivotally coupled anterior and posterior segments, said anterior and posterior segments being pivotal about a fulcrum axis spanning along an entire width of said frame in such a manner that medial edges of said of said anterior and posterior segments bend downwardly and away from said selected rods when said frame is collapsed, lateral edges of said anterior and posterior segments being articulated adjacent to said rails and maintained at an equidistant height from said top ends of said rails during collapsing operations.

9. The support frame of claim 8, wherein said selected rods are bifurcated into anterior and posterior sections vertically aligned above said anterior and posterior segments of said seat support section respectively, each of said anterior and posterior sections having detachable medial ends abutted against each other during the erected position and thereby axially aligned along the horizontal plane defined orthogonal to said rails, said medial ends being downwardly adapted when said frame is collapsed such that a spatial relationship between said other rods is reduced.

10. The support frame of claim 9, further comprising: a seat having monolithically formed back and bottom regions pivotally attached to each other, said back region laying parallel to said rails and orthogonal to said anterior and posterior sections when said frame is erected, said bottom region laying parallel to said rods as well as said anterior and posterior sections when said frame is erected, said seat being removable from said seat support section.

11. The support frame of claim 9, wherein said maintaining means comprises: a plurality of tubular sleeves telescopically positioned about an outer surface of said selected rods such that said medial ends of said anterior and posterior segments are covered and statically engaged when said frame is erected.

12. The support frame of claim 7, further comprising: a tray removably attached directly to said selected rods and situated at an anterior side of said frame, said frame including a plurality of brackets intercalated between said selected rods and said tray in such a manner that said tray is slidably adaptable along a longitudinal length of said selected rods and positioned away from said anterior side of said frame as desired by the caregiver.

* * * * *